US007404434B2

(12) United States Patent
Martin et al.

(10) Patent No.: US 7,404,434 B2
(45) Date of Patent: Jul. 29, 2008

(54) STACKED PLATE HEAT EXCHANGERS AND HEAT EXCHANGER PLATES

(75) Inventors: Michael A. Martin, Hamilton (CA); Doug Vanderwees, Mississauga (CA)

(73) Assignee: Dana Canada Corporation (CA)

( * ) Notice: Subject to any disclaimer, the term of this patent is extended or adjusted under 35 U.S.C. 154(b) by 608 days.

(21) Appl. No.: 10/997,312

(22) Filed: Nov. 24, 2004

(65) Prior Publication Data

US 2006/0032621 A1 Feb. 16, 2006

(30) Foreign Application Priority Data

Aug. 16, 2004 (CA) ..... 2477817

(51) Int. Cl.
*F28F 3/08* (2006.01)

(52) U.S. Cl. ..... 165/167; 165/916

(58) Field of Classification Search ..... 165/167, 165/916

See application file for complete search history.

(56) References Cited

U.S. PATENT DOCUMENTS

| | | | | |
|---|---|---|---|---|
| 55,149 | A | 5/1866 | Nason | |
| 4,376,460 | A * | 3/1983 | Skoog | 165/167 |
| 4,744,414 | A | 5/1988 | Schon | |
| 5,222,551 | A | 6/1993 | Hasegawa et al. | |
| 5,291,945 | A | 3/1994 | Blomgren et al. | |
| 5,327,958 | A | 7/1994 | Machata et al. | |
| 5,931,219 | A | 8/1999 | Kull et al. | |
| 6,164,372 | A | 12/2000 | Persson | |
| 6,167,952 | B1 | 1/2001 | Downing | |
| 6,171,374 | B1 | 1/2001 | Barton | |
| 6,182,746 | B1 | 2/2001 | Wiese | |
| 6,318,456 | B1 | 11/2001 | Brenner et al. | |
| 6,681,846 | B2 | 1/2004 | Angermann et al. | |
| 2003/0098146 | A1 * | 5/2003 | Angermann et al. | 165/167 |
| 2003/0102107 | A1 | 6/2003 | Nilsson et al. | |
| 2003/0201094 | A1 * | 10/2003 | Evans et al. | 165/109.1 |
| 2004/0089438 | A1 | 5/2004 | Valensa | |
| 2006/0011333 | A1 | 1/2006 | Emrich et al. | |

FOREIGN PATENT DOCUMENTS

| | | |
|---|---|---|
| DE | 19716845 A1 | 10/1998 |
| EP | 0 742 418 B1 | 12/1998 |

OTHER PUBLICATIONS

International Search Report for Application No. PCT/CA2005/001208 Mailed Nov. 16, 2005.

* cited by examiner

*Primary Examiner*—William E Tapolcai
(74) *Attorney, Agent, or Firm*—Dykema Gossett PLLC

(57) ABSTRACT

A plate-type heat exchanger is comprised of a stack of dished plates, with the plates being sealed at their margins by nesting sidewalls and the plate bottoms being spaced from one another to define a plurality of flow passages. Each of the plates has two pairs of openings. Two of the openings are formed in bosses which are joined to the sidewall along a portion of their length, thereby avoiding formation of a bypass channel between the bosses and the sidewall and maximizing the plate area available for heat transfer. The other two openings are provided with ribs which support the bosses of upwardly adjacent plates in the stack and which provide channels to provide transverse distribution of fluid across the plate.

31 Claims, 13 Drawing Sheets

FIG.1. ( PRIOR ART )
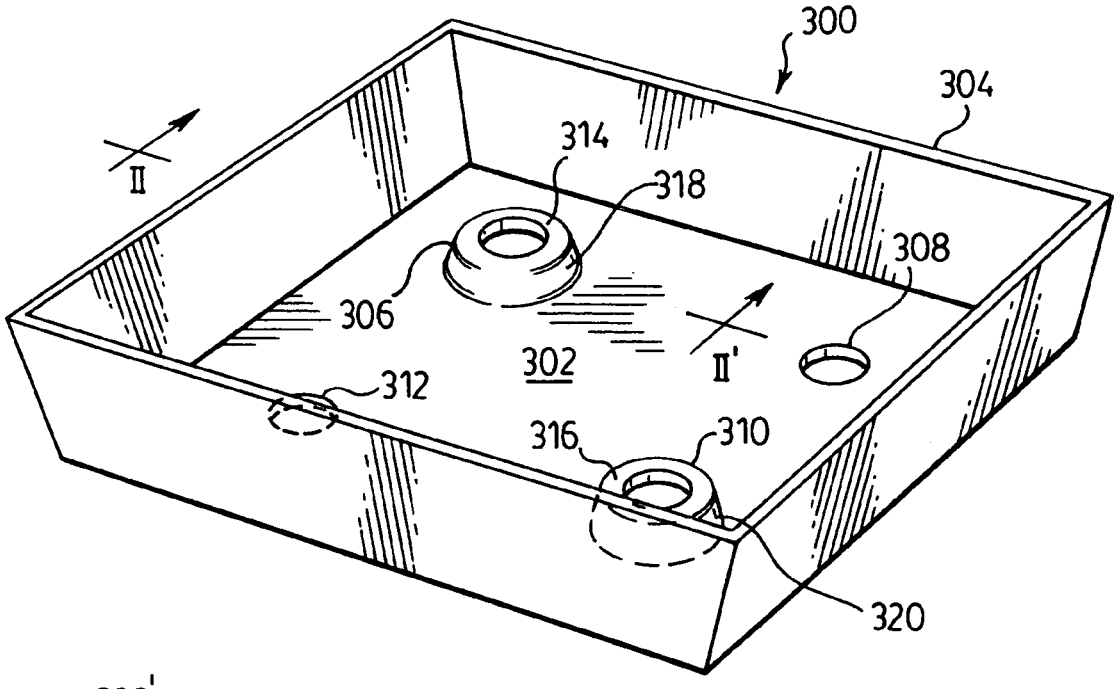
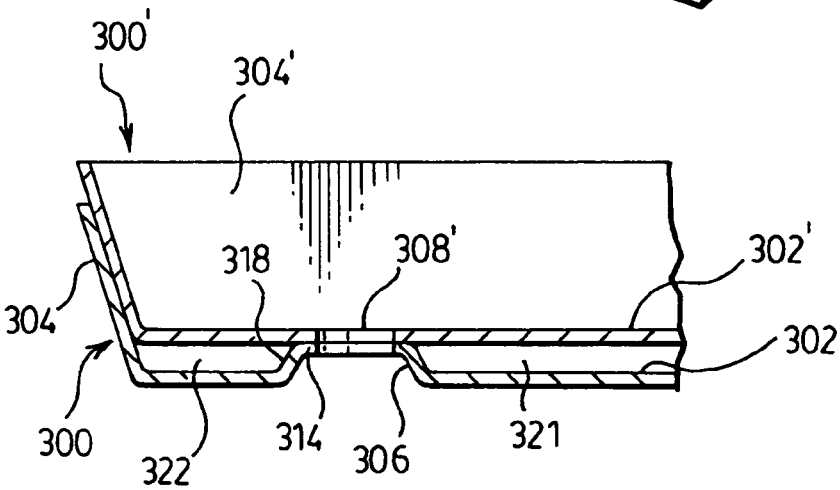
FIG.2. ( PRIOR ART)

STACKED PLATE HEAT EXCHANGERS AND HEAT EXCHANGER PLATES

This application claims priority to Canadian Patent Application No. 2,477,817 filed Aug. 16, 2004.

FIELD OF THE INVENTION

The present invention relates to plate-type heat exchangers, and more particularly to heat exchangers comprising a stack of dished plates. The present invention also relates to plates for such heat exchangers.

BACKGROUND OF THE INVENTION

Plate-type heat exchangers comprising a stack of heat exchanger plates are well known. The individual plates making up the stack may preferably have a generally planar plate bottom with a sloped peripheral sidewall (i.e. dish or tub shaped) which nests with adjacent plates in the stack. During assembly, the sidewalls are sealed together, for example by brazing, to form sealed flow passages for heat exchange fluids.

There is a need for improved heat exchangers of this type having improved flow distribution and efficiency.

SUMMARY OF THE INVENTION

In one aspect, the present invention provides a heat exchanger comprising a plurality of plates arranged in a stack, with fluid flow passages being provided between adjacent plates in the stack. Each of the plates comprises: (a) a plate bottom having a top surface and a bottom surface, the top surface facing upwardly and the bottom surface facing downwardly, the plate bottom having a peripheral edge; (b) a continuous plate wall extending upwardly and outwardly from the peripheral edge of the plate bottom; (c) a first inlet hole and a first outlet hole provided through the plate bottom, the first inlet and outlet holes being spaced from one another and spaced from the peripheral edge of the plate bottom; (d) a second inlet hole and a second outlet hole provided through the plate bottom, the second inlet and outlet holes being spaced from one another, spaced from the first inlet and outlet holes, and spaced from the peripheral edge of the plate bottom, wherein the second inlet and outlet holes are spaced upwardly relative to the first inlet and outlet holes; and (e) a pair of raised bosses having upper surfaces in which the second inlet and outlet holes are provided, the upper surface of each said boss surrounding one of the second inlet and outlet holes and having an outer edge which, for a first part of its length, is joined directly to the plate wall; wherein the plates in said stack are in nested, sealed engagement with one another, with the plate bottoms of adjacent plates being spaced from one another to form said fluid flow passages, with the first inlet and outlet holes in each plate being aligned with the second inlet and outlet holes, respectively, of an adjacent plate, and with the upper surfaces of the bosses in each plate sealingly engaging the bottom surface of an adjacent plate; wherein directly joining the upper surfaces of the bosses to the plate wall prevents fluid from flowing between the outer edge of each of the bosses and the plate wall.

In another aspect, the present invention provides a heat exchanger plate comprising: (a) a plate bottom having a top surface and a bottom surface, the top surface facing upwardly and the bottom surface facing downwardly, the plate bottom having a peripheral edge; (b) a continuous plate wall extending upwardly and outwardly from the peripheral edge of the plate bottom; (c) a first pair of holes provided through the plate bottom, the first pair of holes being spaced from one another and from the peripheral edge of the plate bottom; (d) a second pair of holes provided through the plate bottom, the second pair of holes being spaced from one another, spaced from the first pair of holes, and spaced from the peripheral edge of the plate bottom, wherein the second pair of holes are spaced upwardly relative to the first pair of holes; and (e) a pair of raised bosses having upper surfaces in which the second pair of holes are provided, the upper surface of each said boss surrounding one of the second pair of holes and having an outer edge which, for a first part of its length, is joined directly to the plate wall.

BRIEF DESCRIPTION OF THE DRAWINGS

The invention will now be described, by way of example only, with reference to the accompanying drawings in which:

FIG. 1 is a perspective view showing a heat exchanger plate according to the prior art;

FIG. 2 is a cross-sectional side elevation along line II-II' of FIG. 1 showing a pair of stacked heat exchanger plates according to the prior art;

DETAILED DESCRIPTION OF PREFERRED EMBODIMENTS

Figure 3:
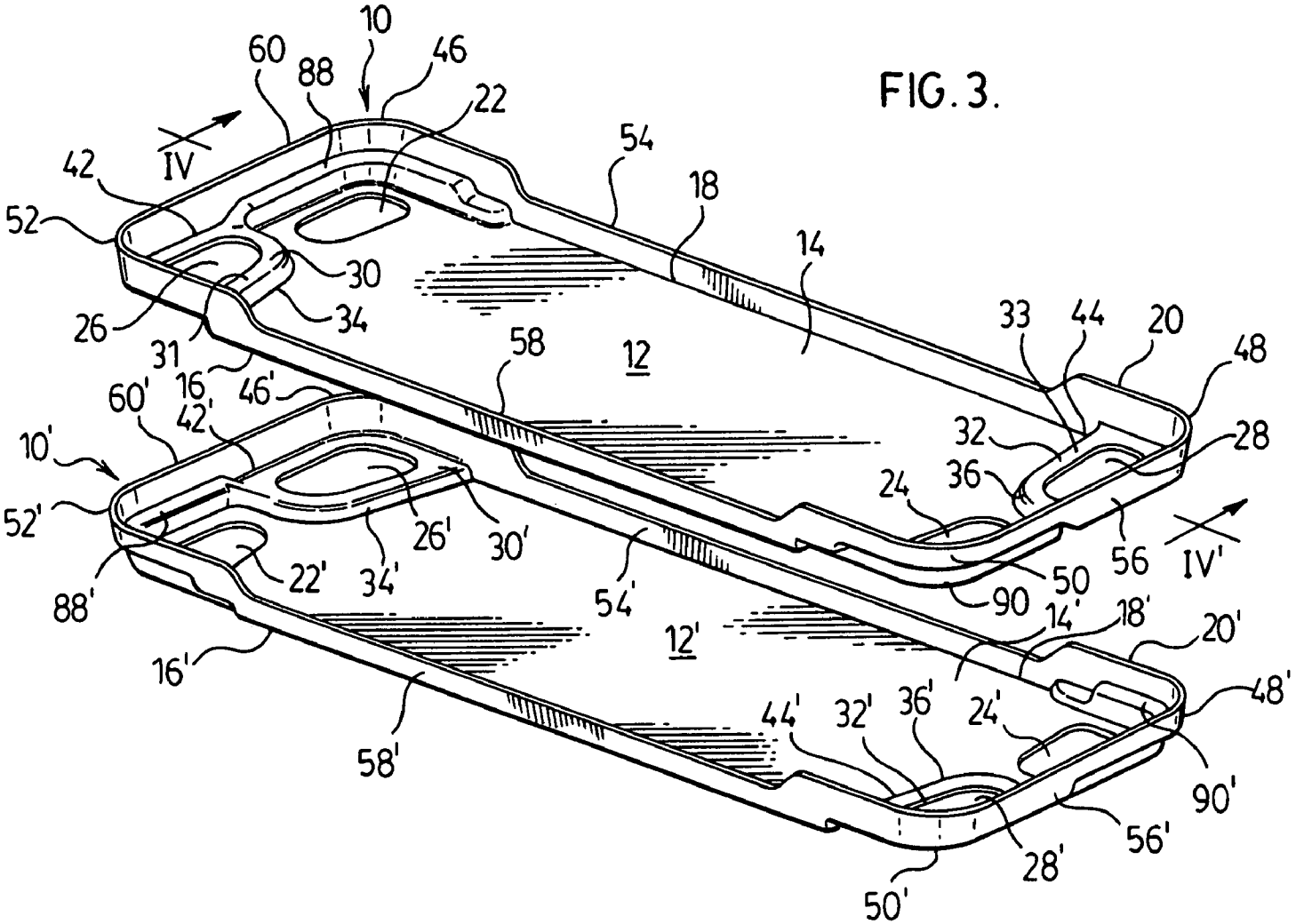
FIG. 3 is a perspective view showing a pair of heat exchanger plates according to the present invention.

FIG. 1 is a perspective view of a conventional heat exchanger plate 300 according to the prior art comprising a rectangular plate bottom 302 surrounded on all sides by an upwardly and outwardly sloping plate wall 304. Heat exchanger plates of this type are commonly known as "dished" plates. The plate bottom 302 is provided with four holes 306, 308, 310 and 312 at its corners, each of the holes serving as an inlet or outlet for a heat exchange fluid. Diagonally opposed holes 306 and 310 are raised relative to the plate bottom 302 and are in the form of raised bosses having flat upper surfaces 314, 316 and circumferential side walls 318, 320. As can be seen from FIG. 1, the raised holes 306, 310 are spaced from the plate wall 304. The other two holes 308, 312 are coplanar with the bottom wall 302.

A plurality of plates of the type shown in FIG. 1 may be stacked on top of one another to form a stacked plate heat exchanger. FIG. 2 is a partial cross-sectional view through a pair of stacked plates, one of which is plate 300 of FIG. 1 and the other of which is its identical mirror image, identified as plate 300'. The plates 300 and 300' are stacked with their plate walls 304, 304' in nested, sealed engagement. The raised holes 306, 310 of plate 300 align with flat holes 308', 312' of plate 300', and the flat upper surfaces 314, 316 of raised holes 306, 310 are sealed to the bottom 302' of plate 300' around the peripheries of holes 308', 312'. As shown in FIG. 2, a flow passage 321 for heat exchange fluid is formed between the plate bottoms 302, 302' of plates 300, 300'. In order to enhance heat exchange efficiency, a fin or turbulizer (not shown) may be provided in the flow passage 321.

It can be seen from FIG. 2 that a bypass channel 322 is formed between the raised hole 306 and the plate wall 304. The top and bottom of the channel 322 is defined by the plate bottoms 302 of the adjacent plates 300, and the sides of the channel 322 are defined by the plate wall 304 and the side wall 318 of raised hole 306. Since there is no driving force to cause fluid to flow through channel 322, this channel is considered a "dead space" which lowers the overall efficiency of the heat exchanger.

FIG. 3 illustrates a pair of plates 10 and 10' according to a first preferred embodiment of the present invention. Plates 10 and 10' are mirror images of one another and are therefore substantially identical. For this reason, only plate 10 is described in detail below. Unless otherwise noted, the description of plate 10 also applies to plate 10', and vice versa, and like elements of plates 10 and 10' are identified by like reference numerals.

Plate 10 comprises a plate bottom 12 having a top surface 14 and an opposed bottom surface 16. The top surface 14 faces upwardly and the bottom surface 16 faces downwardly. It will be appreciated that the terms "upwardly" and "downwardly" are used herein as terms of reference only, and that heat exchangers and heat exchanger plates according to the invention can have any desired orientation when in use. The plate bottom 12 has a continuous peripheral edge 18 at which it is joined to a continuous plate wall 20. The plate wall 20 extends upwardly and outwardly from the peripheral edge 18 of the plate bottom, preferably being slightly angled relative to the upward direction.

Plate 10 is provided with four holes for passage of fluids, including a first pair of holes 22 and 24 (also referred to herein as first inlet hole 22 and first outlet hole 24). The first inlet and outlet holes 22,24 extend through the plate bottom 12 and are spaced from one another and from the peripheral edge 18 of the plate bottom 12. In the preferred embodiment shown in the drawings, the first inlet and outlet holes 22, 24 are coplanar with one another. It will, however, be appreciated that holes 22 and 24 are not necessarily coplanar.

The plate 10 also has a second pair of holes 26 and 28 (also referred to herein as the second inlet hole 26 and the second outlet hole 28). The second inlet and outlet holes 26,28 are also spaced from one another, spaced from the first inlet and outlet holes 22,24 and spaced from the peripheral edge 18 of the plate bottom 12. In the preferred embodiment shown in the drawings, the second inlet and outlet holes 26, 28 are coplanar with one another. It will, however, be appreciated that holes 26 and 28 are not necessarily coplanar.

Although the holes of plate 10 may be identified herein as "inlets" or "outlets", this is done for ease of reference only. It will be appreciated that the heat exchange fluid may flow from inlet to outlet, or in the reverse direction from the outlet to the inlet.

Figure 4:
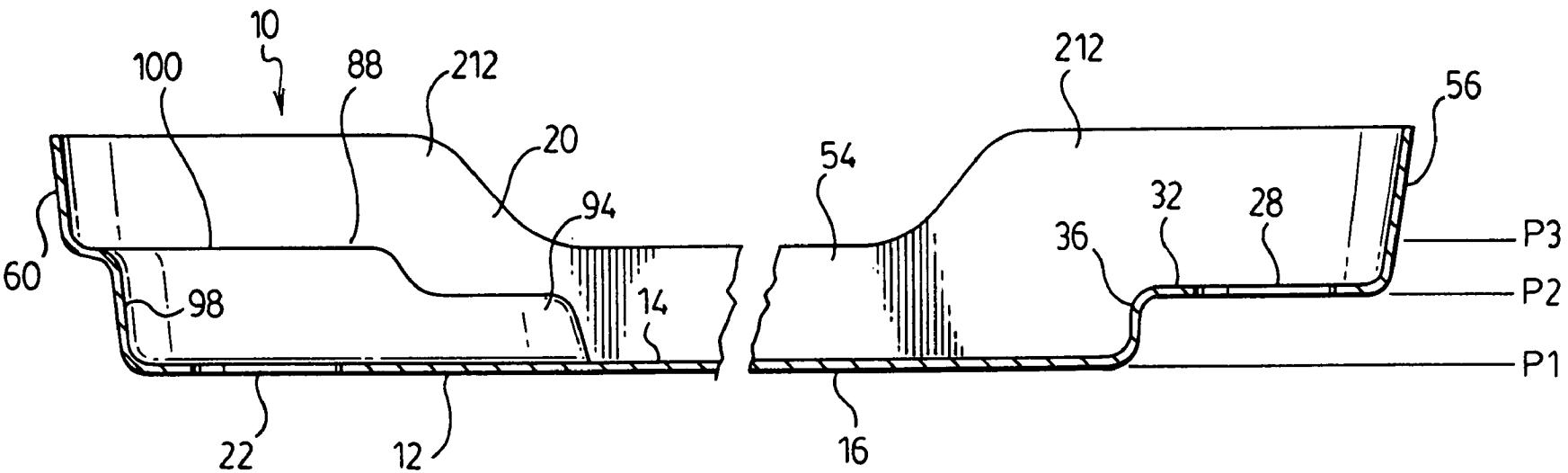
FIG. 4 is a cross-section along line IV-IV' of FIG. 3.

The relative heights of holes 22, 24, 26 and 28 are illustrated in the cross-section of FIG. 4. The plate bottom 12 and the first inlet and outlet holes 22, 24 are located in a first plane P1. The second inlet and outlet holes 26,28 are located in a plane P2 which is spaced upwardly relative to the plane P1. That is, the second inlet and outlet holes 26,28 are raised relative to the first inlet and outlet holes 22,24 for reasons which will be explained below. As mentioned above, the respective holes 22, 24 and/or 26, 28 are not necessarily coplanar. In this case, the planes in which holes 26, 28 are located are spaced upwardly relative to the planes in which holes 22, 24 are located.

As shown in FIG. 3, the plate 10 further comprises a pair of bosses 30, 32 protruding upwardly from the plate bottom 12 and surrounding the second inlet and outlet holes 26,28 respectively. The bosses 30 and 32 have flat upper surfaces 31 and 33 which, in the preferred embodiment shown in the drawings, are coplanar with the second inlet and outlet holes 26,28 respectively, i.e. they are located in plane P2 shown in FIG. 4. It will, however, be appreciated that the upper surfaces 31, 33 of bosses 30, 32 are not necessarily flat and are not necessarily coplanar with the holes 26, 28. For example, it may be preferred to provide ribs or other protrusions (not shown) on the upper surfaces 31, 33 which are concentric with holes 26, 28 and may assist in brazing the heat exchanger plates together.

Figure 5:
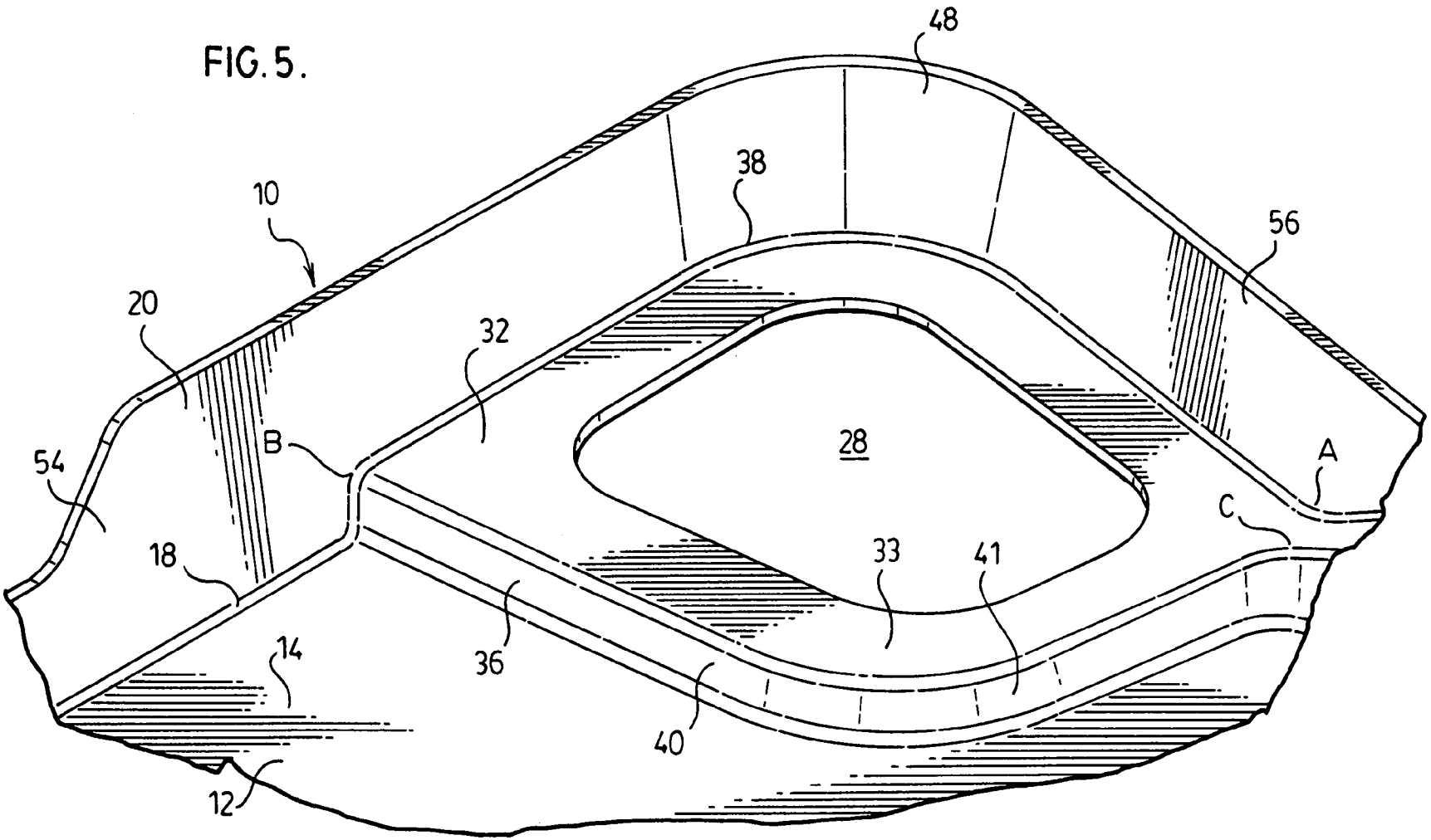
FIG. 5 is a close-up perspective view of a corner of a plate of FIG. 3.

The boss 30 has a peripheral edge 34 extending about substantially its entire periphery. Similarly, boss 32 has a peripheral edge 36 extending about substantially its entire periphery. As shown in FIG. 5, the peripheral edge 36 of boss 32 is joined directly to the plate wall 20 along a first part 38 of its length, i.e. approximately between points A and B in FIG. 5. Also shown in FIG. 5, the outer edge 36 is joined to the plate bottom 12 through a peripheral side wall 40 of boss 32 along a second part 41 of its length, i.e. approximately between points B and C.

As discussed in greater detail below, the outer edge 36 of boss 32 is directly joined to the plate wall 20 so as to avoid the formation of a significant bypass channel between the boss 32 and the plate wall 20, thereby avoiding the problems described above in connection with prior art plate 300 shown in FIGS. 1 and 2. It will be appreciated that the first part 38 of the outer edge 36 of boss upper surface 33 need only be directly joined to the plate wall 20 along a portion of the distance between points A and B in order to effectively prevent fluid from flowing between boss 32 and plate wall 20. It will be appreciated that the above description of boss 32 shown in FIG. 5 also applies to boss 30.

In preferred embodiments of the invention, the bosses 30, 32 are formed in the plate 10 by stamping and punching. As shown in the drawings, the bosses 30,32 are preferably formed as close as possible to the plate wall 20 in order to avoid formation of a bypass channel between the holes 26, 28 and the plate wall 20, while providing bosses 30,32 of sufficient width to provide adequate contact for brazing.

The plate 10 may be of any suitable shape. In the preferred embodiments shown in the drawings, the plate is preferably rectangular, having four corners 46,48,50,52, and such that the plate wall 20 has four sides 54,56,58,60 which intersect at the corners. In some preferred embodiments of the inventions, the plate 10 is square. Although the preferred plates according to the invention are square or rectangular, it is also possible to provide heat exchanger plates according to the invention having other polygonal shapes, with hexagonal being a preferred example of a possible shape. The corners of the plates can be angular or, as in the preferred embodiment shown in the drawings, may be rounded. Furthermore, the invention can also be applied to plates having non-polygonal shapes, such as circular or oval plates.

In a rectangular or square plate such as plate 10, the holes 22,24,26,28 are preferably located as close as possible to the corners 46,48,50,52 of the plate bottom 12 in order to maximize the heat exchange area between the holes and to avoid formation of dead spaces between bosses 30, 32 and the plate wall 20. Where the holes are located at the corners, each of the bosses 30,32 is preferably also formed in the corners and is joined to two adjacent sides of the plate wall 20. In the preferred embodiment shown in FIG. 3, the boss 30 surrounding hole 26 is located at corner 52 and is joined to sides 58 and 60 of the plate wall 20. Similarly, the boss 32 surrounding hole 28 is located at corner 48 and is joined to sides 54 and 56 of plate wall 20.

In preferred plate 10, the first pair of holes 22,24 are diagonally opposed to one another and the second pair of holes 26,28 are also diagonally opposed to one another. Fluid flowing between the inlets and outlets is therefore forced to follow a generally diagonal path across the plate, thereby enhancing heat exchange. It will, however, be appreciated that holes 22, 24 and holes 26, 28 are not necessarily diagonally opposed, but rather may be directly opposed on the same side of the plate 10.

Plate 10 also preferably comprises a pair of ribs 88,90 adjacent the first inlet and outlet holes 22, 24 respectively. Rib 88, located adjacent first inlet hole 22, is now described below with reference to the close-up of FIG. 6. Rib 88 comprises a first end 92, and second end 94 and an intermediate portion 96 extending along the plate wall 20 between the ends 92,94. The intermediate portion 96 preferably comprises an upwardly extending rib side wall 98 which is integrally connected to a rib upper surface 100. The first end 92 of rib 88 is joined to the boss 30 of second inlet hole 26. The intermediate portion 96 of rib 88 is located between the plate wall 20 and the first inlet hole 22, is spaced from the inlet hole 22, and extends from a proximal side 102 of the hole 22 to a distal side 104 of hole 22. The second end 94 of rib 88 is located adjacent the distal side 104 of the hole 22 and is joined to the plate bottom 12 and the plate wall 20.

Similarly, the rib 90 (FIGS. 9, 10) comprises a first end 106, a second end 108 and an intermediate portion 110, the intermediate portion 110 comprising a rib side wall 112 and a rib upper surface 114. The intermediate portion 110 of rib 90 is located between the plate wall 20 and the first outlet hole 24, is spaced from the first outlet hole 24, and extends from a proximal side 116 of hole 24 to a distal side 118 of hole 24. The second end 108 of rib 90 is located at the distal side 118 of hole 24 and is joined to the plate bottom 12.

As shown in the drawings, particularly in FIG. 4, the side wall 98 of rib 88 extends upwardly from the plate bottom 12 to the rib upper surface 100 which is joined to the plate wall 20. The upper surface 100,114 of each rib 88,90 is spaced upwardly relative to the holes 22, 24, 26 and 28 and lies in a plane P3 shown in FIG. 4.

Figure 7:
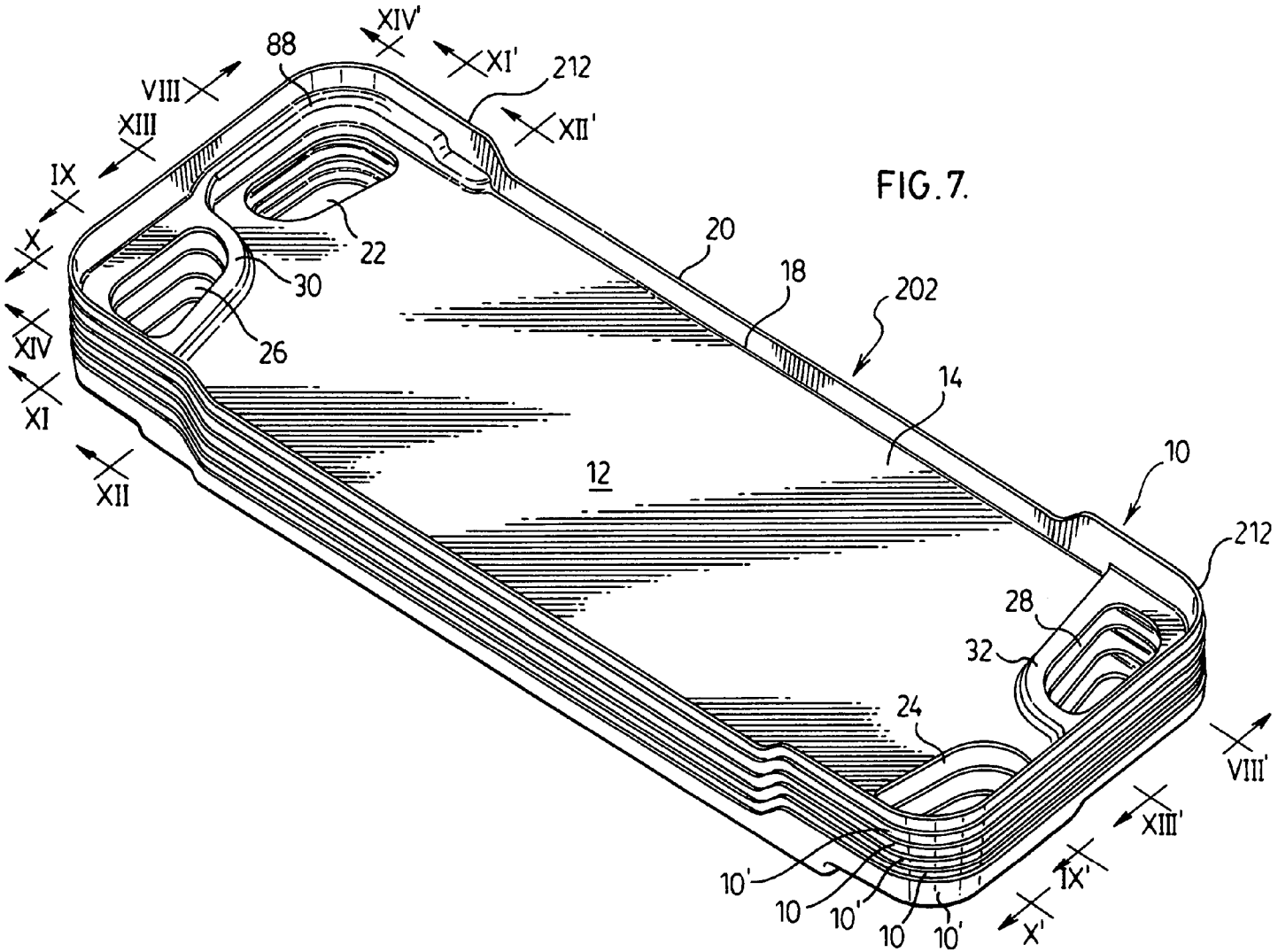
FIG. 7 is a perspective view of a stack comprising the heat exchanger plates of FIG. 3.

The following is a description of a heat exchanger according to the present invention comprising a stack 202 of plates 10, 10'. A portion of stack 202 is illustrated in FIG. 7 and the subsequent cross-sectional views. The stack 202 comprises a plurality of plates 10, 10' arranged in alternating layers, the plates 10,10' being oriented as in the exploded view of FIG. 3.

Figure 8:
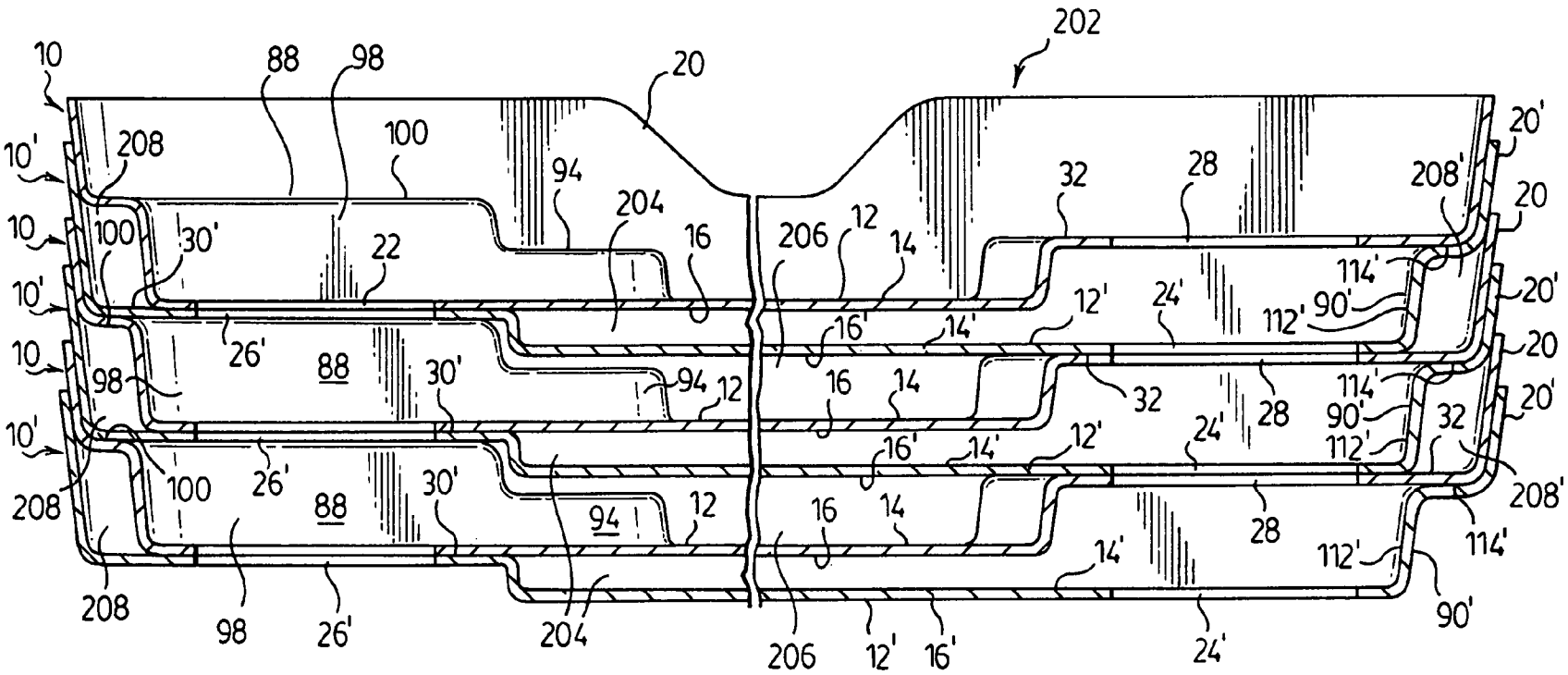
FIG. 8 is a cross-section along line VIII-VIII' of FIG. 7.
Figure 9:
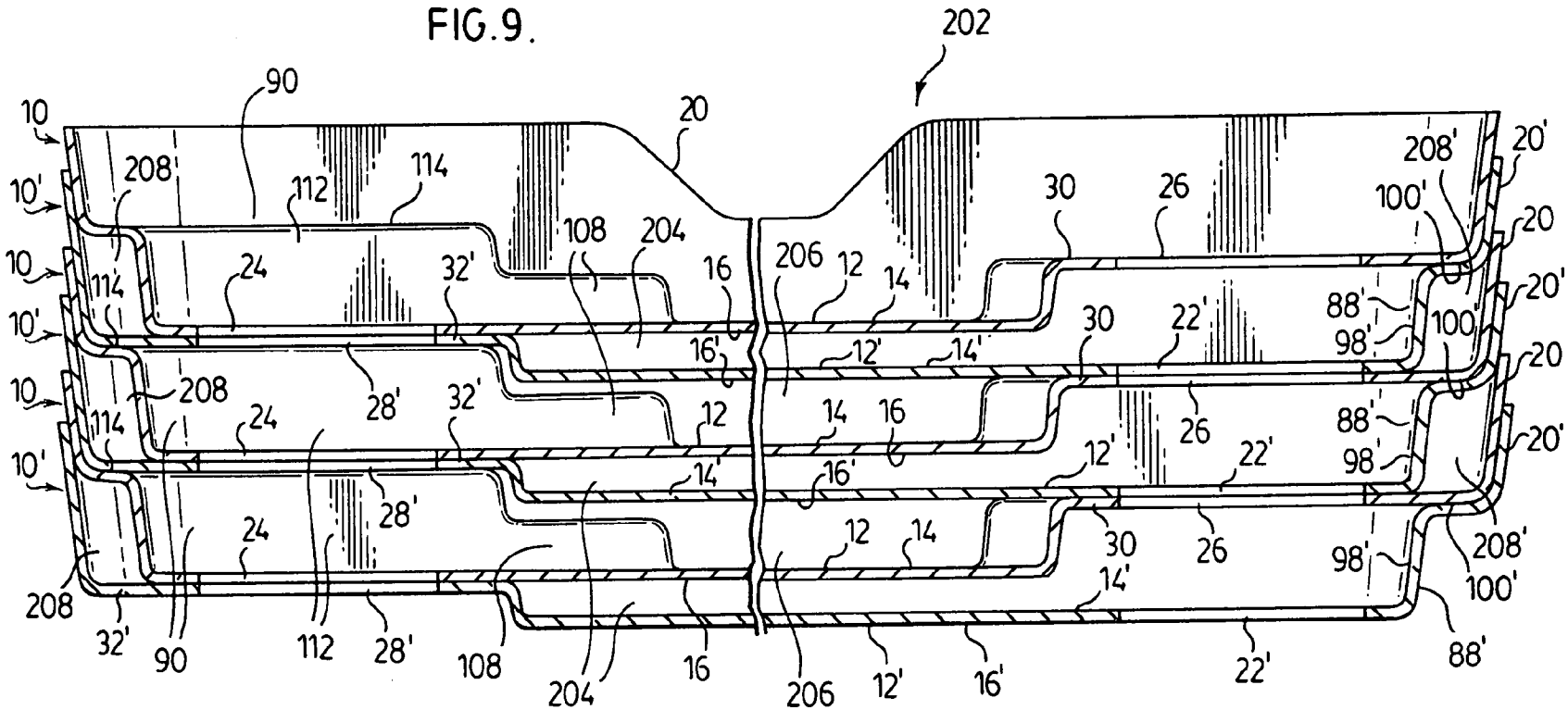
FIG. 9 is a cross-section along line IX-IX' of FIG. 7.

As shown in the longitudinal cross sections of FIGS. 8 and 9, the plate walls 20, 20' of plates 10,10' have a slight outward slope in order to nest (i.e. overlap) with one another along their entire lengths, thereby forming a seal around the outer peripheries of plates 10,10' in the stack 202. The amount of overlap between adjacent plate walls 20,20' is sufficient so that a reliable braze joint can be provided between adjacent plates 10,10'. FIGS. 8 and 9 also show that the plate bottoms 12,12' of adjacent plates 10,10' are spaced from each other to define a plurality of fluid flow passages 204, 206 for flow of heat exchange fluids.

As shown in the drawings, fluid flow passages 204 are formed in alternating layers of plate stack 202 between the bottom surface 16 of a plate 10 and a top surface 14' of an adjacent (underlying) plate 10'. As shown in FIG. 9, fluid flow passages 204 are in flow communication with the second inlet hole 26 of plate 10 and with the first inlet hole 22' of adjacent plate 10', the holes 26 and 22' being aligned with one another in the stack 202. As shown in FIG. 8, flow passages 204 are also in communication with the diagonally opposed second outlet hole 28 of plate 10 and the first outlet hole 24' of adjacent plate 10', the holes 28 and 24' being aligned with one another. Furthermore, the flow passages 204 in alternating layers of heat exchanger 200 are in flow communication with one another through the inlet holes 26, 22' and the outlet holes 28, 24' mentioned above.

Fluid flow passages 206 are formed in alternating layers of heat exchanger 200 between the bottom surface 16' of a plate 10' and the top surface 14 of an adjacent (underlying) plate 10. Fluid flow passages 206 are in flow communication with the first outlet hole 24 of plate 10 and with the second outlet hole 28' of plate 10', with holes 24 and 28' being aligned with one another. Flow passages 206 are also in flow communication with the diagonally opposed first inlet hole 22 of plate 10 and the second inlet hole 26' of plate 10', the holes 22 and 26' being aligned with one another. The flow passages 206 in alternating layers of heat exchanger 200 are in flow communication with one another through the outlet holes 24, 28' and the inlet holes 22, 26' mentioned above.

As shown in FIGS. 8 and 9, the upper surfaces 31', 33' of bosses 30', 32' are in sealed engagement with a portion of the bottom surface 16 of plate 10 which surrounds the first inlet and outlet holes 22, 24 respectively. The area of contact between bosses 30', 32' and the bottom surface 16 of plate 10 is sufficient to provide a reliable braze joint between the two. It can be seen that the bosses 30', 32' are in sealed engagement with the bottom surface 16 of plate 10 around the entire periphery of inlet holes 26', 22 and outlet holes 28', 24, thereby sealing passages 204, 206 from one another and preventing mixing of the heat exchange fluids flowing through passages 204, 206.

It will be appreciated that locating holes 22, 24, 26, 28 as close as possible to the corners maximizes the total area of the fluid flow passages 204, 206 which is available for heat exchange, and in which a turbulizer may preferably be provided. Furthermore, directly joining the bosses 30, 32 to the plate wall 20 effectively prevents the formation of a bypass channel as in prior art plates of this type. These improvements provided by the present invention provide improved heat exchange efficiency over prior art heat exchangers described above.

Although not shown in the drawings, the fluid flow passages 204, 206 may preferably be provided with structures which enhance heat exchange efficiency by forcing the fluid to follow a tortuous path through passages 204, 206. For example, passages 204, 206 may be provided with corrugated fins or turbulizers which are well known in the art. Alternatively, the plate bottom 12 could be provided with ribs, corrugations, dimples or other protrusions for the same purpose.

In some preferred embodiments of the invention, it may be preferred to construct a heat exchanger according to the invention from heat exchanger plates identical in all respects to plates 10, but with all four sides 54, 56, 58, 60 being of equal length so that the plates are square. It will be appreciated that provision of square plates will eliminate the need for mirror image plates 10'. All the plates of such a heat exchanger would preferably be identical to each other, with the different hole orientations in adjacent layers being provided by 90 degree rotation of each plate relative to adjacent plates in the stack, the rotation taking place about an upwardly directed axis. Such a heat exchanger may be more economical to manufacture than heat exchangers constructed from plates 10 and 10', since the need for separate tooling to produce mirror image plates 10' is eliminated.

As mentioned above, plate 10 is preferably provided with ribs 88 and 90 located between the plate wall 20 and the first inlet and outlet holes 22 and 24, respectively. The ribs 88, 90 fulfill two functions described below.

Firstly, the ribs 88 and 90 are open at their ends to provide flow distribution channels extending transversely across the plate 10. Each of the flow distribution channels extends from the second inlet or outlet hole 26, 28 to a distal side of an adjacent one of the first inlet or outlet holes 22, 24. This enhances flow distribution of the fluid and thereby improves efficiency of the heat exchanger. The transverse flow distribution channels according to the present invention are distinct from the bypass channels of prior art plates described above. Specifically, one end of the flow distribution channel is in direct communication with an inlet or outlet hole, thereby providing a path of reduced flow resistance through which fluid is caused to flow. This enhances distribution or fluid transversely across the plate and also lowers the overall pressure drop of the heat exchanger.

Figure 10:
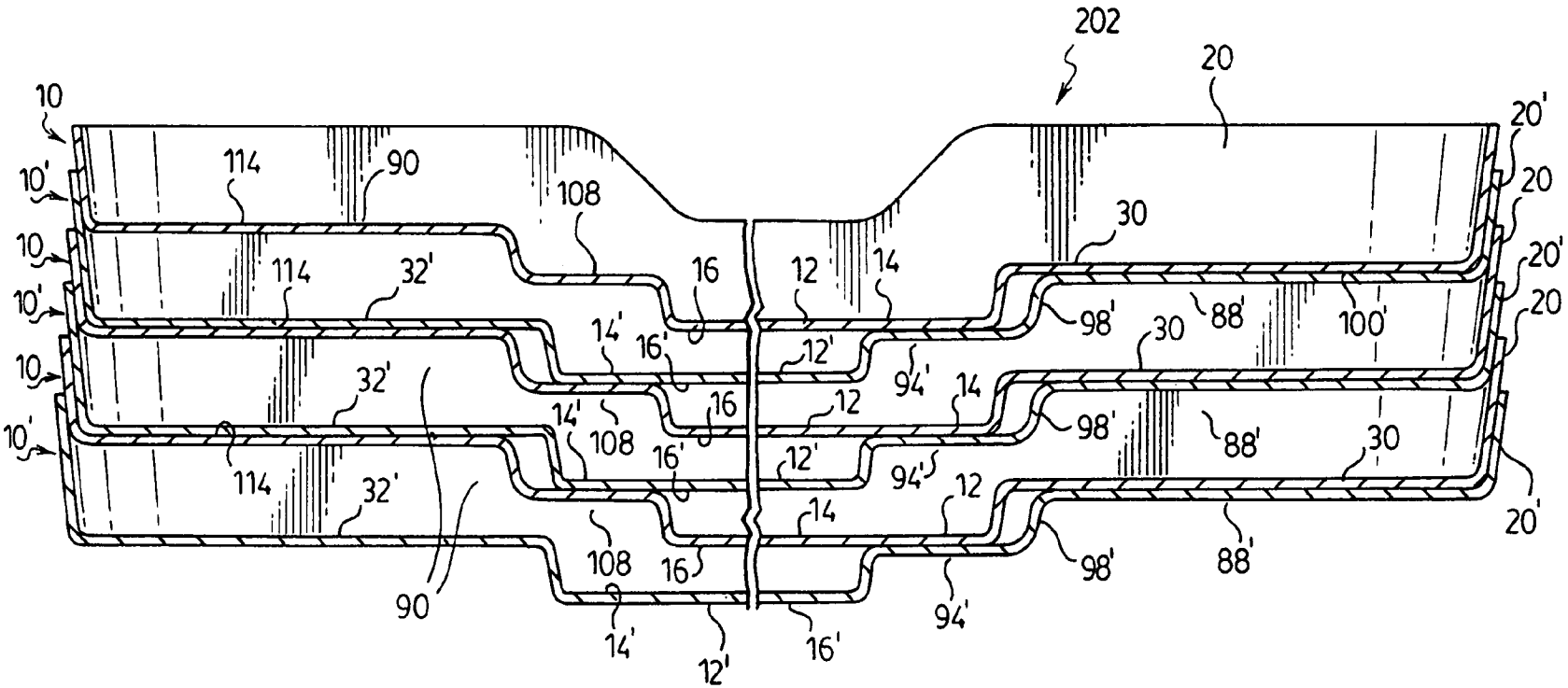
FIG. 10 is a cross-section along line X-X' of FIG. 7.
Figure 11:
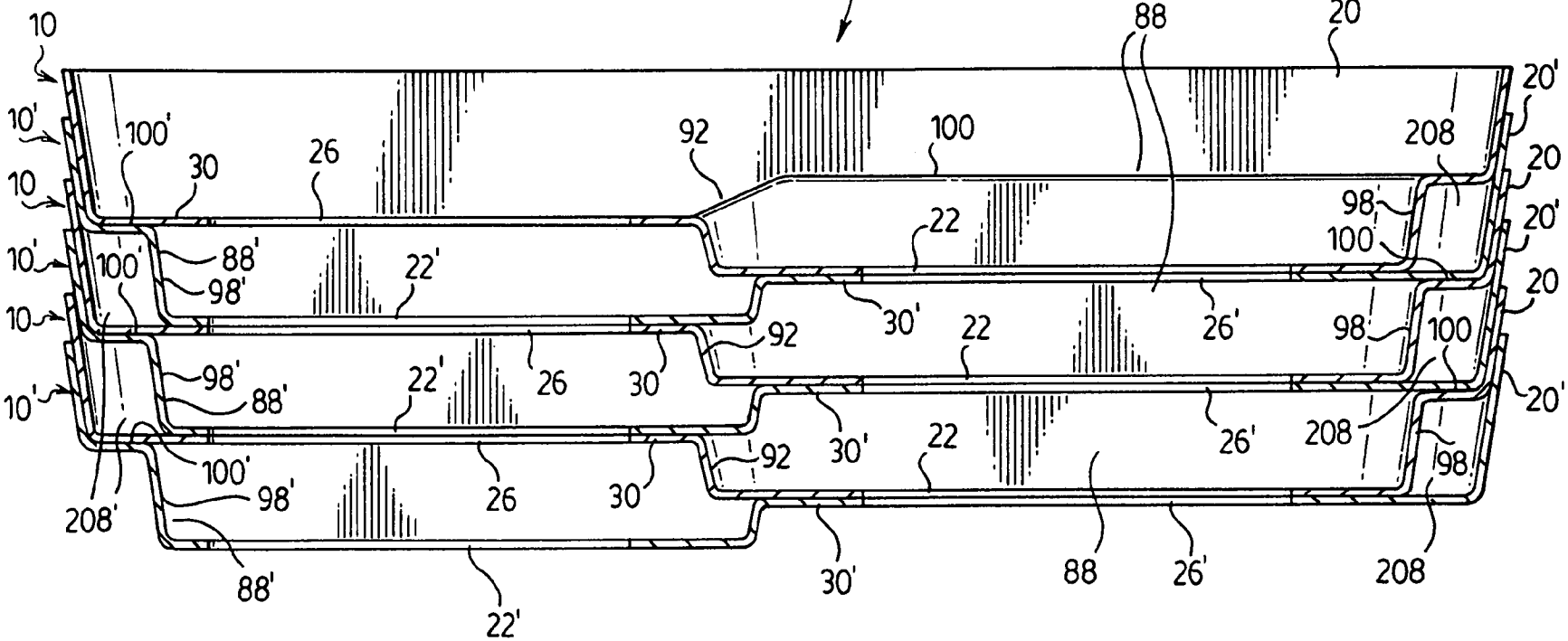
FIG. 11 is a cross-section along line XI-XI' of FIG. 7.

Secondly, the upper surfaces 100, 114 of ribs 88 and 90 engage the undersides of bosses 30, 32 in an upwardly adjacent plate in the assembled heat exchanger, thereby providing support for the bosses 30, 32 and enhancing strength of the heat exchanger. The support function of the ribs 88, 90 can be explained by reference to the cross section of FIG. 10, showing alternating layers of ribs 90, 88' and bosses 30, 32'. As shown in this drawing, the rib upper surface 100' of each rib 88' is in direct engagement with the boss 30 of an adjacent (overlying) plate 10, and the rib upper surface 114 of each rib 90 is in direct engagement with the boss 32' of an adjacent (overlying) plate 10'. This engagement between ribs 90, 88' and bosses 30, 32' provides a relatively large surface for brazing and provides support for the bosses 30, 32'.

As mentioned above, the upper surface 100' of rib 88' is located in plane P3 of FIG. 4, whereas the holes 22, 24 are located in plane P1 and holes 26, 28 are located in plane P2. In order to provide engagement between ribs 88' and bosses 30 as in FIG. 10, it is preferred that the rib upper surface 100' (plane P3) be about twice as high as the adjacent boss 30 (plane P2) along substantially the entire intermediate portion 96' of the rib 88'.

FIG. 10 also shows that the second end 94' of rib 88' has a height such that it engages the lower surface 16 of the plate bottom 12 of overlying plate 10, thereby providing additional support for the plate 10. As shown in FIG. 4, the upper surface of the second end 94 of rib 88 preferably lies in plane P2, i.e. it is coplanar with the second pair of holes 26, 28 and their surrounding bosses 30, 32.

The flow distribution channel 208 formed by rib 88 is now described with reference to FIGS. 8, 9 and 11 to 14. As shown in 8, 9 and 11, the intermediate portion 96 of rib 88 is comprised of the rib side wall 98 and the adjoining rib upper surface 100. These form the front and top walls respectively of the flow distribution channel 208. The rear wall of the channel 208 is formed by the plate wall 20' of an adjacent (underlying) plate 10' and the bottom wall of channel 208 is formed by the upper surface of the boss 30' of underlying plate 10'. It will thus be seen that the flow distribution channel 208 is sealed along the intermediate portion 96 of rib 88, thereby providing a sealed passage for fluid to flow between the first and second ends 92, 94 of rib 88. The fluid flows through channel 208 from the proximal side 116 to the distal side 118 of the first outlet hole 24, thereby distributing a portion of the heat exchange fluid transversely across the plate 10.

Figure 6:
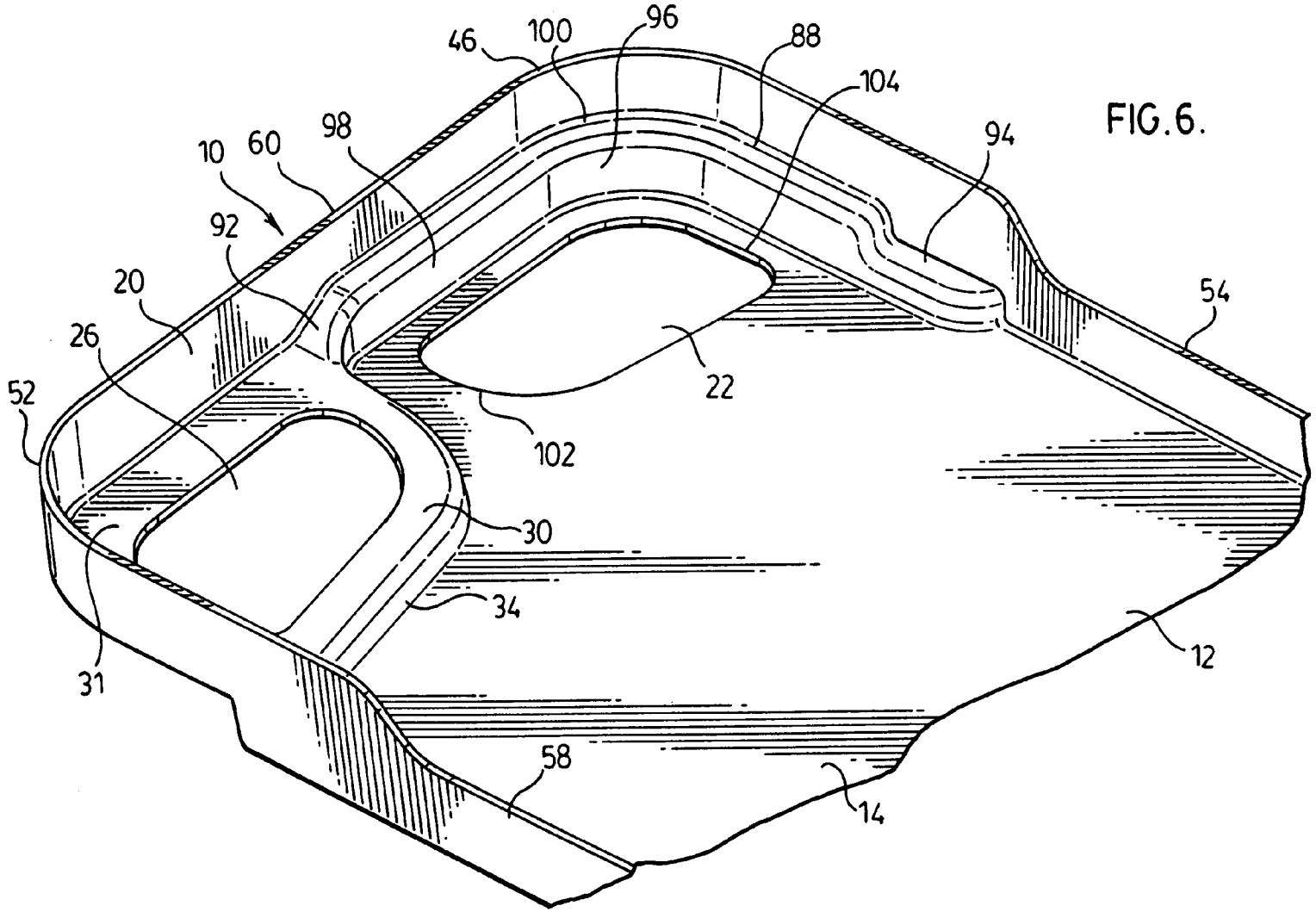
FIG. 6 is a close-up perspective view one end of a plate of FIG. 3.
Figure 13:
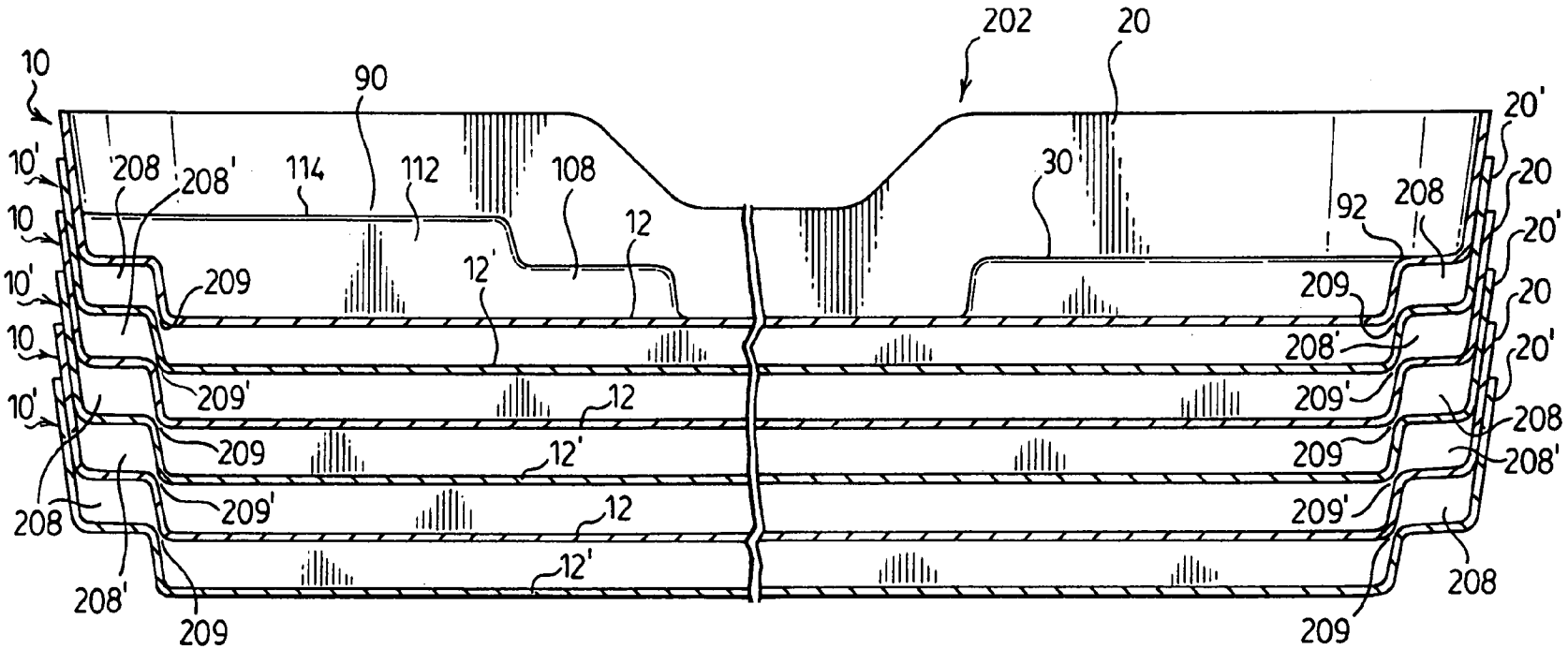
FIG. 13 is a cross-section along line XIII-XIII' of FIG. 7.
Figure 14:
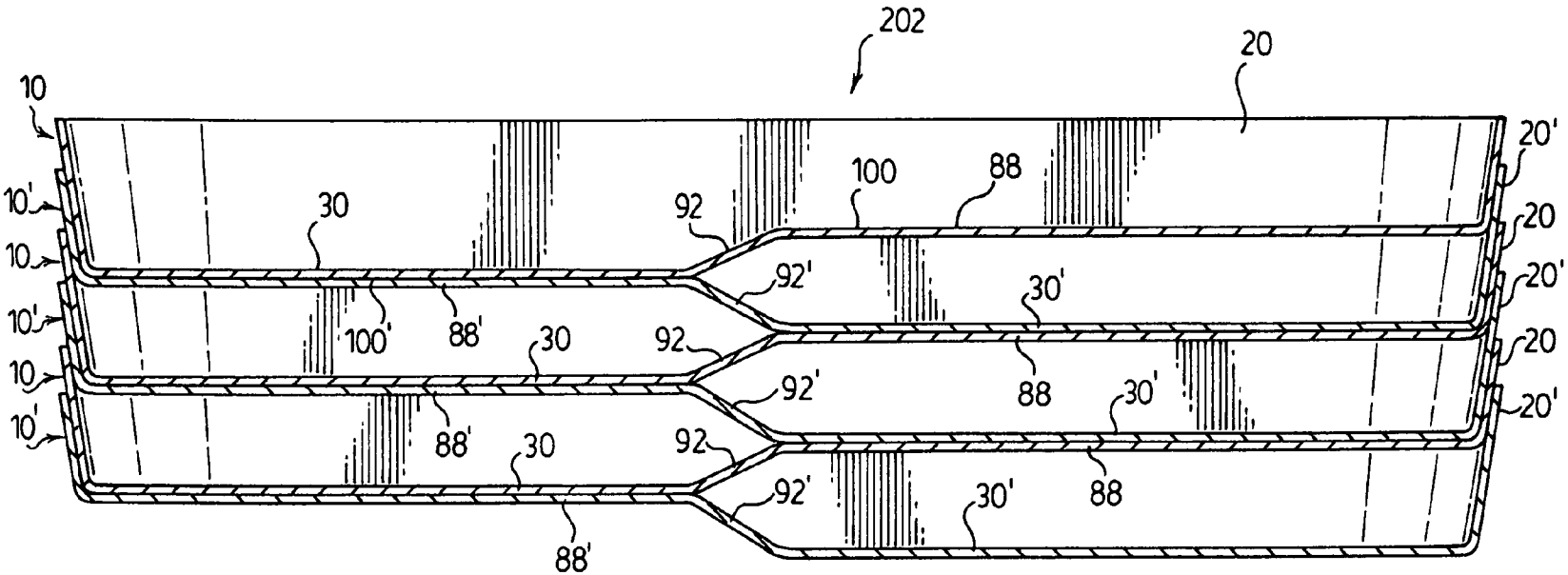
FIG. 14 is a cross-section along line XIV-XIV' of FIG. 7.

As mentioned above, the first and second ends 92, 94 of rib 88 are open to the flow passage 204. As shown in FIG. 6, the first end 92 of rib 88 slopes downwardly and flares away from the plate wall 20 in order to form a smooth transition with the boss 30 and to provide fluid communication with the underside of boss 30 and the fluid flow passage 204. FIG. 13 is a longitudinal cross-section bisecting the plate stack 202, extending through the flared transition between the first end 92 of rib 88 and the boss 30. As shown, small gaps 209 are formed between the adjacent plates 10, 10' which allow fluid communication between the flow distribution channels 208 of ribs 88 and the fluid flow passages 204.

The ribs 88' of plates 10' also have flared transitions at their first ends 92' where they join bosses 30'. As shown in FIG. 13, the flared transitions at ends 92' of ribs 88' form small gaps 209' which allow fluid communication between the flow distribution channels 208' of ribs 88' and the fluid flow passages 206.

Figure 12:
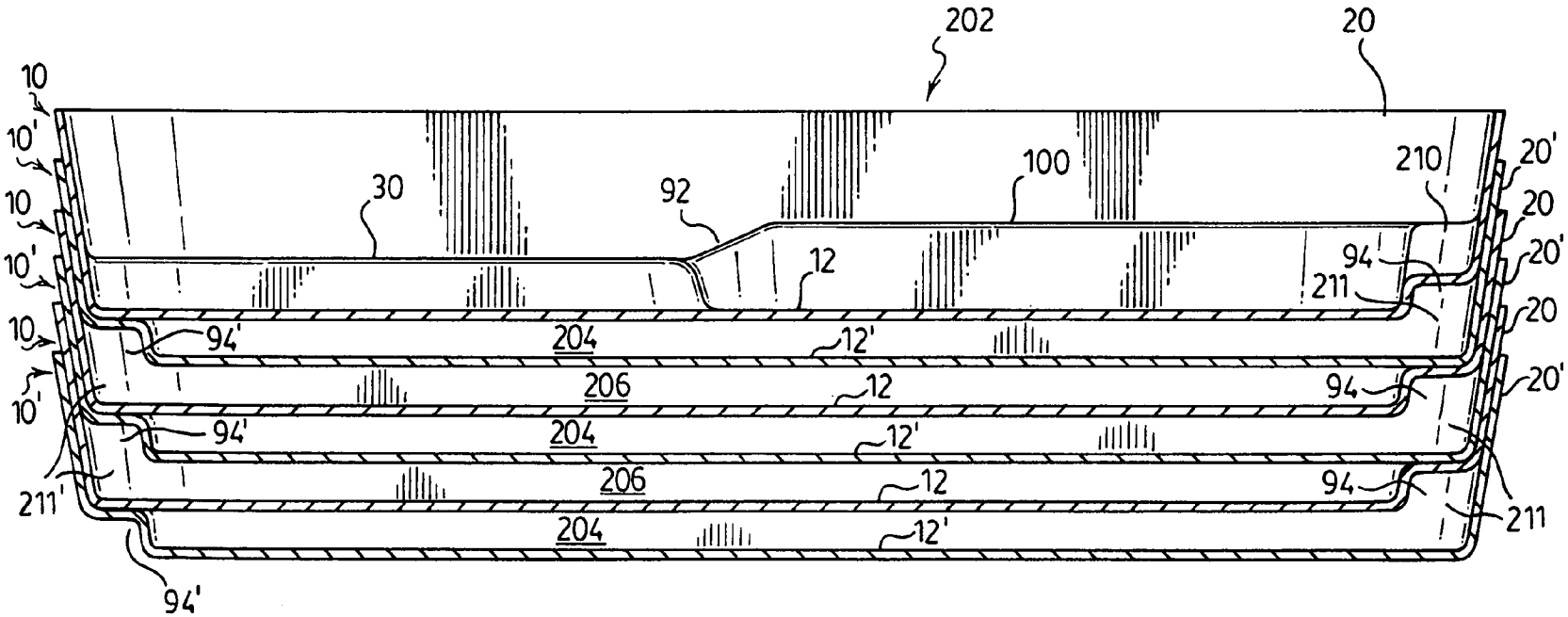
FIG. 12 is a cross-section along line XII-XII' of FIG. 7.

At the opposite end of rib 88, shown in FIG. 12, a step 210 is formed between the intermediate portion 96 and the second end 94 of rib 88. As shown, the second end 94 of rib 88 has an open bottom 211 which is in communication with the flow passage 204, thereby fluid communication between fluid distribution channel 208 and the fluid flow passages 206. Similarly, the second end portions 94' have open bottoms 211' which permit fluid communication between fluid distribution channel 208' and the flow passage 206.

In order to provide sufficient brazing surface area between the plate walls 20 of adjacent plates 10 which, as seen in the cross section of FIG. 4, would otherwise be reduced by the provision of ribs 88, 90, the plate walls are provided with upward extensions 212 in the regions where ribs 88, 90 are provided.

Although the invention has been described in relation to certain preferred embodiments, it is not limited thereto. Rather, the invention includes all embodiments which may fall within the scope of the following claims.

What is claimed is:

1. A heat exchanger comprising a plurality of plates arranged in a stack, with fluid flow passages being provided between adjacent plates in the stack, each of the plates comprising:

(a) a plate bottom having a top surface and a bottom surface, the top surface facing upwardly and the bottom surface facing downwardly, the plate bottom having a peripheral edge;

(b) a continuous plate wall extending upwardly and outwardly from the peripheral edge of the plate bottom;

(c) a first inlet hole and a first outlet hole provided through the plate bottom, the first inlet and outlet holes being spaced from one another and spaced from the peripheral edge of the plate bottom;

(d) a second inlet hole and a second outlet hole provided through the plate bottom, the second inlet and outlet holes being spaced from one another, spaced from the first inlet and outlet holes, and spaced from the peripheral edge of the plate bottom, wherein the second inlet and outlet holes are spaced upwardly relative to the first inlet and outlet holes;

(e) a pair of raised bosses having upper surfaces in which the second inlet and outlet holes are provided, the upper surface of each said boss surrounding one of the second inlet and outlet holes and having an outer edge which, for a first part of its length, is joined directly to the plate wall; and (f) a pair of ribs, each of the ribs comprising a first end, a second end and an intermediate portion extending between the ends, the intermediate portion comprising a rib side wall and a rib upper surface; each of the ribs extending along the plate wall, the first end being joined to one of the bosses, the intermediate portion located between the plate wall and one of the first inlet and outlet holes, the intermediate portion extending from a side of said hole which is proximal to the first end of the rib to a side of the said hole which is distal to the first end of the rib, the second end of the rib being located at the distal side of the hole and being joined to the plate bottom;

wherein the plates in said stack are in nested, sealed engagement with one another, with the plate bottoms of adjacent plates being spaced from one another to form said fluid flow passages, with the first inlet and outlet holes in each plate being aligned with the second inlet and outlet holes, respectively, of an adjacent plate, and with the upper surfaces of the bosses in each plate sealingly engaging the bottom surface of an adjacent plate;

wherein directly joining the upper surfaces of the bosses to the plate wall prevents fluid from flowing between the outer edge of each of the bosses and the plate wall; and wherein the upper surface of each rib engages a bottom surface of one of the bosses of an overlying plate.

2. The heat exchanger of claim 1, wherein the plate bottom of each plate is rectangular and has four corners, and wherein the plate wall has four sides which intersect at the corners.

3. The heat exchanger of claim 1, wherein the plate bottom of each plate is square and has four corners, and wherein the plate wall has four sides of equal length which intersect at the corners, and wherein the first inlet and outlet of each plate is displaced by 90 degrees relative to the first inlet and outlet of an adjacent plate.

4. The heat exchanger of claim 2, wherein each of the holes is located proximate one of the corners.

5. The heat exchanger of claim 4, wherein each of the bosses is joined to two sides of the plate wall.

6. The heat exchanger of claim 4, wherein the first inlet and outlet of each plate are diagonally opposed to one another and wherein the second inlet and outlet of each plate are diagonally opposed to one another.

7. The heat exchanger of claim 1, wherein the upper surfaces of the bosses are substantially flat.

8. The heat exchanger of claim 7, wherein the upper surfaces of the bosses are substantially coplanar with one another.

9. The heat exchanger of claim 1, wherein the first inlet and outlet holes are substantially coplanar with one another.

10. The heat exchanger of claim 1, wherein the second inlet and outlet holes are substantially coplanar with one another.

11. The heat exchanger of claim 1, wherein the first inlet and outlet holes are both located in a first plane, the second inlet and outlet holes are both located in a second plane, and wherein the second plane is spaced upwardly relative to the first plane.

12. The heat exchanger of claim 1, wherein the rib side wall of each rib extends upwardly from the plate bottom to the rib upper surface, and wherein the rib upper surface is joined to the plate wall.

13. The heat exchanger of claim 1, wherein the rib upper surface is spaced upwardly relative to the first inlet and outlet holes and relative to the second inlet and outlet holes.

14. The heat exchanger of claim 1, wherein each of the ribs forms a flow distribution channel which is in flow communication with one of the fluid flow passages at the ends of the rib and which is sealed along the intermediate portion of the rib.

15. The heat exchanger of claim 14, wherein each of the flow distribution channels is defined by the sidewall and upper wall of one of the ribs of a first plate and by the plate wall and an upper surface of one of the bosses of an underlying plate.

16. The heat exchanger of claim 15, wherein the flow distribution channel formed by each of said ribs is in fluid flow communication with a fluid flow passage between the plate in which said rib is formed and an immediately underlying one of said plates.

17. The heat exchanger of claim 1, wherein at least some of the fluid flow passages are provided with turbulence-enhancing elements selected from the group comprising corrugated fins, turbulizers and turbulence-enhancing protrusions formed in the plate bottoms.

18. A heat exchanger plate, comprising:

(a) a plate bottom having a top surface and a bottom surface, the top surface facing upwardly and the bottom surface facing downwardly, the plate bottom having a peripheral edge;

(b) a continuous plate wall extending upwardly and outwardly from the peripheral edge of the plate bottom;

(c) a first pair of holes provided through the plate bottom, the first pair of holes being spaced from one another and from the peripheral edge of the plate bottom;

(d) a second pair of holes provided through the plate bottom, the second pair of holes being spaced from one another, spaced from the first pair of holes, and spaced from the peripheral edge of the plate bottom, wherein the second pair of holes are spaced upwardly relative to the first pair of holes;

(e) a pair of raised bosses having upper surfaces in which the second pair of holes are provided, the upper surface of each said boss surrounding one of the second pair of holes and having an outer edge which, for a first part of its length, is joined directly to the plate wall; and (f) a pair of ribs, each of the ribs comprising a first end, a second end and an intermediate portion extending between the ends, the intermediate portion comprising a rib side wall and a rib upper surface; each of the ribs extending along the plate wall, the first end being joined to one of the bosses, the intermediate portion located between the plate wall and one of the first pair of holes, the intermediate portion extending from a side of said hole which is proximal to the first end of the rib to a side of the hole which is distal to the first end of the rib, the second end of the rib being located at the distal side of said hole and being joined to the plate bottom.

19. The heat exchanger plate of claim 18, wherein the plate bottom is rectangular and has four corners, and wherein the plate wall has four sides which intersect at the corners.

20. The heat exchanger plate of claim 18, wherein the plate bottom is square and has four corners, and wherein the plate wall has four sides of equal length which intersect at the corners.

21. The heat exchanger plate of claim 19, wherein each of the holes is located proximate to one of the corners.

22. The heat exchanger plate of claim 21, wherein each of the bosses is joined to two sides of the plate wall.

23. The heat exchanger plate of claim 21, wherein the first pair of holes are diagonally opposed to one another and wherein the second pair of holes are diagonally opposed to one another.

24. The heat exchanger plate of claim 18, wherein the upper surfaces of the bosses are substantially flat.

25. The heat exchanger plate of claim 24, wherein the upper surfaces of the bosses are substantially coplanar with one another.

26. The heat exchanger plate of claim 18, wherein the first pair of holes are substantially coplanar with one another.

27. The heat exchanger plate of claim 18, wherein the second pair of holes are substantially coplanar with one another.

28. The heat exchanger plate of claim 18, wherein the first pair of holes is located in a first plane, the second pair of holes is located in a second plane, and wherein the second plane is spaced upwardly relative to the first plane.

29. The heat exchanger plate of claim 18, wherein substantially all portions of the plate bottom, except the raised bosses and the second pair of openings formed therein, are coplanar with the first pair of holes.

30. The heat exchanger plate of claim 18, wherein the rib side wall of each rib extends upwardly from the plate bottom to the rib upper surface, and wherein the rib upper surface is joined to the plate wall.

31. The heat exchanger plate of claim 25, wherein the rib upper surface is spaced upwardly relative to the first pair of holes and the second pair of holes.

* * * * *